US010648625B2

(12) United States Patent
Chen

(10) Patent No.: US 10,648,625 B2
(45) Date of Patent: May 12, 2020

(54) PRIMARY LIGHT DISTRIBUTION STRUCTURE OF DIRECTIONAL LIGHT SOURCE

(71) Applicant: NINGBO YAMAO OPTOELECTRONICS CO., LTD., Zhejiang (CN)

(72) Inventor: Hui Chen, Zhejiang (CN)

(73) Assignee: NINGBO YAMAO OPTOELECTRONICS CO., LTD., Zhejiang (CN)

( * ) Notice: Subject to any disclaimer, the term of this patent is extended or adjusted under 35 U.S.C. 154(b) by 0 days.

(21) Appl. No.: 16/131,948

(22) Filed: Sep. 14, 2018

(65) Prior Publication Data

US 2019/0316741 A1 Oct. 17, 2019

(30) Foreign Application Priority Data

Apr. 11, 2018 (CN) ..... 2018 2 0510267

(51) Int. Cl.

| | |
|---|---|
| ***F21K 9/233*** | (2016.01) |
| ***F21V 29/70*** | (2015.01) |
| ***F21K 9/238*** | (2016.01) |
| ***F21V 29/89*** | (2015.01) |
| ***F21V 17/10*** | (2006.01) |
| ***F21V 5/04*** | (2006.01) |
| ***F21V 19/00*** | (2006.01) |

(52) U.S. Cl.

CPC ..... *F21K 9/233* (2016.08); *F21K 9/238* (2016.08); *F21V 5/04* (2013.01); *F21V 17/10* (2013.01); *F21V 19/0055* (2013.01); *F21V 29/70* (2015.01); *F21V 29/89* (2015.01)

(58) Field of Classification Search

CPC ..... F21K 9/233; F21K 9/238; F21V 19/0055; F21V 5/04; F21V 17/10; F21V 29/70; F21V 29/89

See application file for complete search history.

(56) References Cited

U.S. PATENT DOCUMENTS

2012/0069545 A1* 3/2012 Choi ..... F21V 3/00 362/84
2014/0001945 A1* 1/2014 Yamamoto ..... F21V 5/04 313/111

(Continued)

*Primary Examiner* — Kevin Quarterman
(74) *Attorney, Agent, or Firm* — Terry M. Sanks, Esq.; Beusse Wolter Sanks & Maire, PLLC

(57) ABSTRACT

The present invention discloses a primary light distribution structure of a directional light source comprises a lamp cup, wherein the lamp cup is provided with a lamp cap at an end; a heat conducting plate, disposed inside the lamp cup and located at a middle portion of the lamp cup, the periphery of the heat conducting plate being in interference fit with and connection with the lamp cup; a power source, disposed inside the lamp cup and located between the lamp cup and the heat conducting plate, the power source being connected to the lamp cap; a light source plate, fixed to the heat conducting plate by means of a plurality of screws, the power source being electrically connected to the light source plate; and a lens structure, covering on the light source plate. In the present invention, the primary light distribution structure is configured such that a larger beam angle is available.

3 Claims, 5 Drawing Sheets

(56) References Cited

U.S. PATENT DOCUMENTS

| | | | | |
|---|---|---|---|---|
| 2014/0240994 | A1* | 8/2014 | Lim | F21V 3/0625<br>362/382 |
| 2014/0301080 | A1* | 10/2014 | Lim | H05K 3/366<br>362/249.01 |
| 2014/0307427 | A1* | 10/2014 | Joo | F21V 23/023<br>362/186 |
| 2015/0354780 | A1* | 12/2015 | Wang | G02B 3/08<br>362/294 |
| 2017/0268754 | A1* | 9/2017 | Lee | F21V 19/0055 |

* cited by examiner

PRIMARY LIGHT DISTRIBUTION STRUCTURE OF DIRECTIONAL LIGHT SOURCE

BACKGROUND OF THE INVENTION

Field of the Invention

The invention relates to the technical field of a directional light source, and more particularly, to a light distribution structure of the directional light source.

Description of the Related Art

Generally, after a directional light source of an LED is distributed, light in its beam angle is unevenly distributed. In particular, it is observed that the central light intensity is high, and a stepped drop is presented. In addition, yellow spots and black dots can be found on the illuminated object, and stray light is emitted outside the beam angle.

When replacing the traditional light source, the directional light source must be matched to the light distribution curve of the original product, thus, requirements for light environment can be met.

SUMMARY OF THE INVENTION

Given that the foregoing problems exist in the prior art, the present invention provides a primary light distribution structure of a directional light source.

In order to achieve the above purposes, the present invention adopts the following technical solutions.

A primary light distribution structure of a directional light source comprises a lamp cup, the lamp cup being provided with a lamp cap at an end; a heat conducting plate, disposed inside the lamp cup and located at a middle portion of the lamp cup, the periphery of the heat conducting plate being in interference fit with and connection with the lamp cup; a power source, disposed inside the lamp cup and located between the lamp cup and the heat conducting plate, the power source being connected to the lamp cap; a light source plate, fixed to the heat conducting plate by means of a plurality of screws, the power source being electrically connected to the light source plate; and a lens structure, covering on the light source plate.

In the primary light distribution structure of the directional light source, the lens structure comprises a multi-point lens directly facing the light source plate; and a buckle fastened on the multi-point lens, a periphery of the buckle being fixedly connected to the other end of the lamp cup.

In the primary light distribution structure of the directional light source, the lens structure comprises a small lens facing the light source plate, comprising: a lens board taking the form of a circular plate, and a plurality of lens units connected to the lens board, each of the plurality of lens units having a circular table shape and having a convex arc surface; and a planar lens, covering on the small lens, a periphery of the planar lens being fixedly connected to the other end of the lamp cup.

In the primary light distribution structure of the directional light source, the middle portion of the lamp cup extends inwardly to form a fixing plate, and a periphery of the heat conducting plate is fixedly connected to the fixing plate.

In the primary light distribution structure of the directional light source, the heat conducting plate is made from aluminum and has a smooth surface structure.

In the primary light distribution structure of the directional light source, the plurality of screws are self-tapping screws.

By adopting the aforementioned technical solutions, the present invention has the following advantageous effects when compared with the prior art, that is, the primary light distribution structure is configured such that a larger beam angle is available.

BRIEF DESCRIPTION OF THE DRAWINGS

The accompanying drawings, together with the specification, illustrate exemplary embodiments of the present disclosure, and, together with the description, serve to explain the principles of the present invention.

Figure 1:
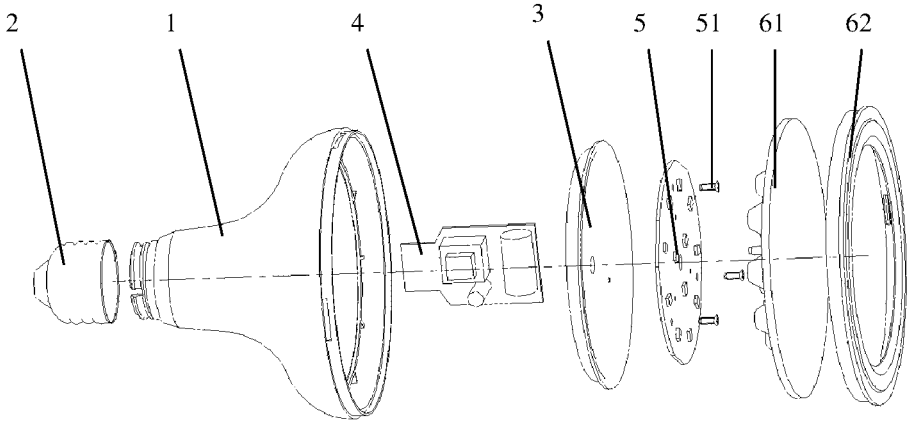
FIG. 1 is a schematic view of a primary light distribution structure of a directional light source according to the present invention.

LIST OF REFERENCE NUMERALS:

1. Lamp cup
11. Fixing plate
2. Lamp cap
3. Heat conducting plate
4. Power source
5. Light source plate
51. Screw
61. Multi-point lens
62. Buckle
63. Small lens
64. Planar lens
65. Curved multi-point lens
66. Planar lens
67. Reflective cover

DETAILED DESCRIPTION

The present invention will now be described more fully hereinafter with reference to the accompanying drawings, in which exemplary embodiments of the invention are shown.

This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, the term "plurality" means a number greater than one.

Hereinafter, certain exemplary embodiments according to the present disclosure will be described with reference to the accompanying drawings.

First Embodiment

Figure 2:
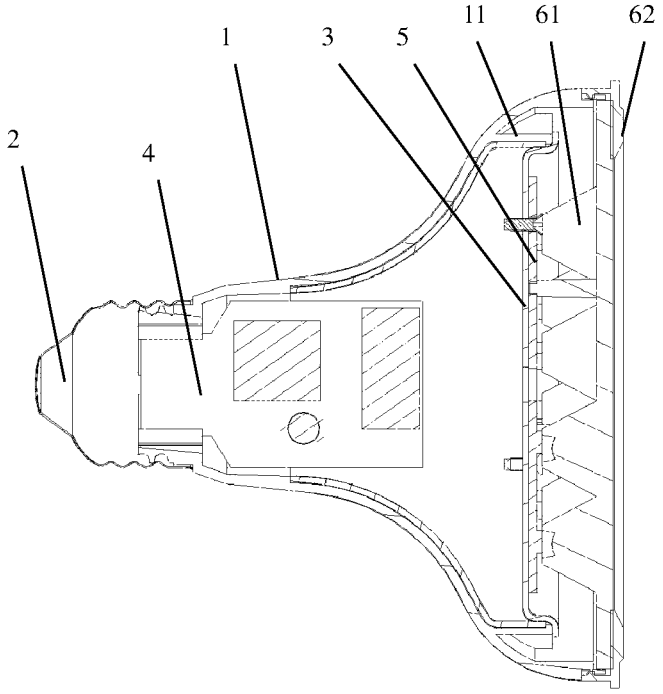
FIG. 2 is a cross-sectional view of a primary light distribution structure of a directional light source according to the present invention.

FIG. 1 is a schematic view of a primary light distribution structure of a directional light source according to the present invention, and FIG. 2 is a cross-sectional view of a primary light distribution structure of a directional light source according to the present invention. Referring now to FIGS. 1 and 2, a primary light distribution structure of a directional light source in the first preferred embodiment is shown, the primary light distribution structure of the directional light source comprising a lamp cup 1, wherein one end of the lamp cup 1 is provided with a lamp cap 2.

Furthermore, the primary light distribution structure of the directional light source in a preferred embodiment further comprises a heat conducting plate 3, which is disposed inside the lamp cup 1 and located at a middle portion of the lamp cup 1, and the periphery of the heat conducting plate 3 is in interference fit with and connection with the lamp cup 1.

In addition, the primary light distribution structure of the directional light source in a preferred embodiment further comprises a power source 4, which is disposed inside the lamp cup 1 and located between the lamp cup 2 and the heat conducting plate 3, and the power source 4 is connected to the lamp cap 2.

Furthermore, the primary light distribution structure of the directional light source in a preferred embodiment further comprises a light source plate 5, which is fixed to the heat conducting plate 3 by means of a plurality of screws 51, and the power source 4 is electrically connected to the light source plate 5.

Furthermore, the primary light distribution structure of the directional light source in a preferred embodiment further comprises a lens structure, covering on the light source plate 5.

Furthermore, the lens structure in a preferred embodiment comprises a multi-point lens 61 directly facing the light source plate 5. The primary light distribution is performed through the multi-point lens 61. By using the multi-point lens, light in the effective beam angle may be evenly distributed and obvious light gradient no longer exists, and yellow spots and black dots may not be present on the illuminated object.

Furthermore, the lens structure in a preferred embodiment further comprises a buckle 62 fastened on the multi-point lens 61, wherein a periphery of the buckle 62 is fixedly connected to the other end of the lamp cup 1.

The foregoing description is only a preferred embodiment of the present invention, not thus limiting the embodiments and scope of the invention.

The invention further has the following implementation based on the abovementioned embodiment. Specifically, in a further embodiment of the invention, referring again to FIGS. 1 and 2, the middle portion of the lamp cup 1 extends inwardly to form a fixing plate 11, and a periphery of the heat conducting plate 3 is fixedly connected to the fixing plate 11.

In a further embodiment of the invention, the heat conducting plate 3 is made from aluminum and has a smooth surface structure.

In a further embodiment of the invention, the plurality of screws 51 are self-tapping screws.

Second Embodiment

Figure 3:
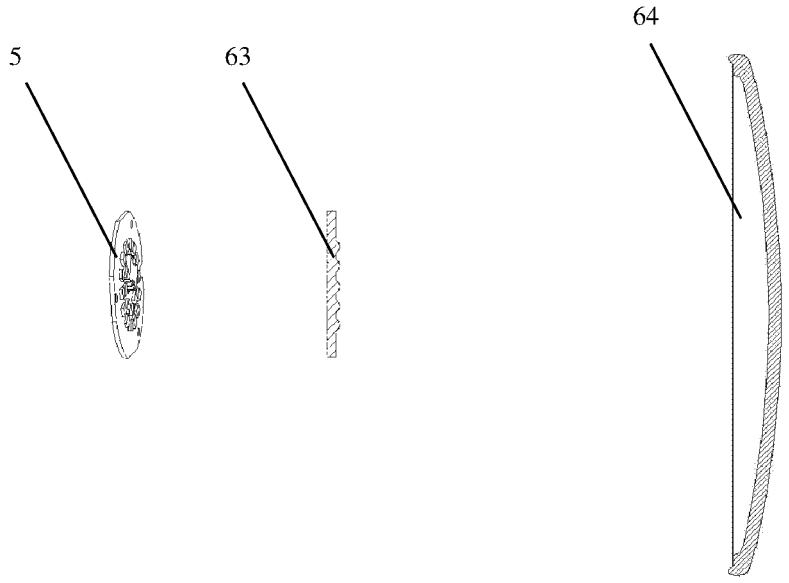
FIG. 3 is the second schematic view of a primary light distribution structure of a directional light source according to the present invention.

FIG. 3 is the second schematic view of a primary light distribution structure of a directional light source according to the present invention. Referring now to FIGS. 1-3, a primary light distribution structure of a directional light source in the second preferred embodiment is shown, the primary light distribution structure of the directional light source comprising a lamp cup 1, wherein one end of the lamp cup 1 is provided with a lamp cap 2.

Furthermore, the primary light distribution structure of the directional light source in a preferred embodiment further comprises a heat conducting plate 3, which is disposed inside the lamp cup 1 and located at a middle portion of the lamp cup 1, and the periphery of the heat conducting plate 3 is in interference fit with and connection with the lamp cup 1.

In addition, the primary light distribution structure of the directional light source in a preferred embodiment further comprises a power source 4, which is disposed inside the lamp cup 1 and located between the lamp cup 2 and the heat conducting plate 3, and the power source 4 is connected to the lamp cap 2.

Furthermore, the primary light distribution structure of the directional light source in a preferred embodiment further comprises a light source plate 5, which fixed to the heat conducting plate 3 by means of a plurality of screws 51, and the power source 4 is electrically connected to the light source plate 5.

Furthermore, the primary light distribution structure of the directional light source in a preferred embodiment further comprises a lens structure, covering on the light source plate 5.

Furthermore, the lens structure in a preferred embodiment comprises a small lens 63 facing the light source plate 5, comprising: a lens board taking the form of a circular plate, and a plurality of lens units connected to the lens board, each of the plurality of lens units having a circular table shape and having a convex arc surface. The primary light distribution is performed through the small lens 63.

Furthermore, the lens structure in a preferred embodiment further comprises a planar lens 64, covering on the small lens 63, and a periphery of the planar lens 64 is fixedly connected to the other end of the lamp cup 1. Since the planar lens 64 serves as a protective cover of the lamp, the planar lens does not exhibit the effect of light distribution.

The invention further has the following implementation based on the abovementioned embodiment. Specifically, in a further embodiment of the invention, the plurality of screws 51 are self-tapping screws.

Third Embodiment

Figure 4:
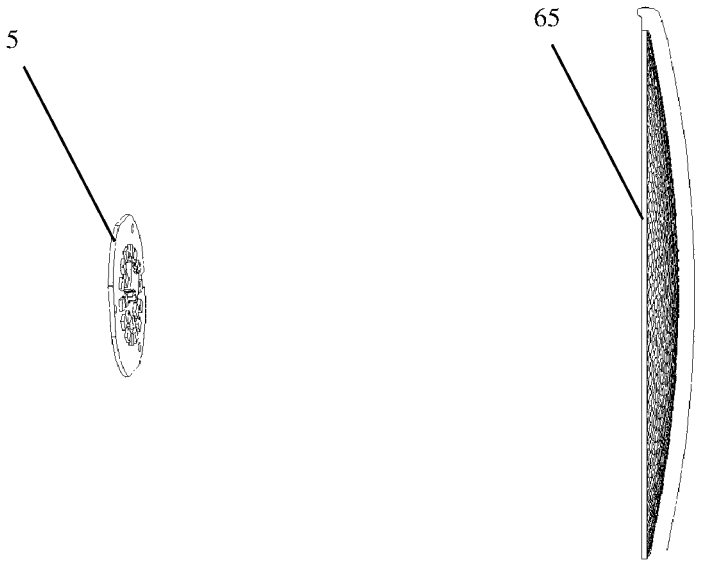
FIG. 4 is the third schematic view of a primary light distribution structure of a directional light source according to the present invention.

FIG. 4 is the third schematic view of a primary light distribution structure of a directional light source according to the present invention. Referring now to FIGS. 1, 2 and 4, a primary light distribution structure of a directional light source in the third preferred embodiment is shown. The third embodiment is the same as the first embodiment except that the lens structure in the first embodiment is replaced with a curved multi-point lens 65, wherein one side of the curved multi-point lens 65 facing the light source plate 5 is a bead surface, and the other side of the curved multi-point lens 65 facing away from the light source plate 5 is a smooth surface. The primary light distribution is performed through the curved multi-point lens 65.

Fourth Embodiment

Figure 5:
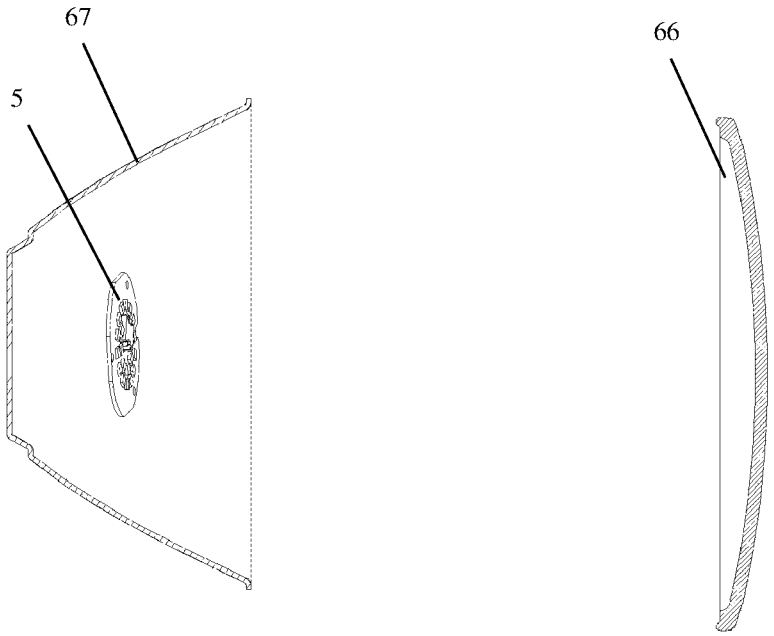
FIG. 5 is the fourth schematic view of a primary light distribution structure of a directional light source according to the present invention.

FIG. 5 is the fourth schematic view of a primary light distribution structure of a directional light source according to the present invention. Referring now to FIGS. 1, 2 and 5, a primary light distribution structure of a directional light source in the fourth preferred embodiment is shown. The fourth embodiment is the same as the first embodiment except that the multi-point lens 61 in the first embodiment is replaced with the planar lens 66, and the heat conducting plate 3 in the first embodiment is replaced with the reflective cover 67. The primary light distribution is performed through the reflective cover 67. The planar lens 66 is the protective cover of the lamp, through which light source is directly refracted by the lamp cup to be visualized.

The above descriptions are only the preferred embodiments of the invention, not thus limiting the embodiments and scope of the invention. Those skilled in the art should be able to realize that the schemes obtained from the content of specification and drawings of the invention are within the scope of the invention. In the present invention, the use of the primary light distribution structure and the reflector makes it possible for the present invention to have higher light distribution efficiency, and to obtain a desired light distribution.

What is claimed is:

1. A primary light distribution structure of a directional light source, comprising:

a lamp cup, the lamp cup being provided with a lamp cap at an end;

a heat conducting plate, disposed inside the lamp cup and located at a middle portion of the lamp cup, the periphery of the heat conducting plate being in interference fit with and connection with the lamp cup;

a power source, disposed inside the lamp cup and located between the lamp cup and the heat conducting plate, the power source being connected to the lamp cap;

a light source plate, fixed to the heat conducting plate by means of a plurality of screws, the power source being electrically connected to the light source plate; and a lens structure, covering on the light source plate;

the lens structure comprises:

a small lens facing the light source plate, comprising: a lens board taking the form of a circular plate, and a plurality of lens units connected to the lens board, each of the plurality of lens units having a circular table shape and having a convex arc surface; and a planar lens, covering on the small lens, a periphery of the planar lens being fixedly connected to the other end of the lamp cup;

the middle portion of the lamp cup extends inwardly to form a fixing plate, a periphery of the heat conducting plate being fixedly connected to the fixing plate.

2. The primary light distribution structure of the directional light source as claimed in claim 1, wherein the heat conducting plate is made from aluminum and has a smooth surface structure.

3. The primary light distribution structure of the directional light source as claimed in claim 1, wherein the plurality of screws are self-tapping screws.

* * * * *